United States Patent [19]

Boyd

[11] Patent Number: 4,858,912

[45] Date of Patent: Aug. 22, 1989

[54] ARM EXERCISING APPARATUS

[76] Inventor: Billy E. Boyd, 2910 E. Hargrove Rd., Tuscaloosa, Ala. 35401

[21] Appl. No.: 234,616

[22] Filed: Aug. 22, 1988

[51] Int. Cl.[4] ..... A63B 21/22

[52] U.S. Cl. ..... 272/67; 272/132; 272/116

[58] Field of Search ..... 272/67, 96, 116, 125, 272/131, 132, 146, 140, 68, 130, 142, 143

[56] References Cited

U.S. PATENT DOCUMENTS

| | | | |
|---|---|---|---|
| 2,777,439 | 1/1957 | Tuttle | 272/132 X |
| 2,832,334 | 4/1958 | Whitelaw | 272/132 |
| 3,708,164 | 1/1973 | Griffin | 272/67 |
| 4,171,802 | 10/1979 | Stoecker | 272/67 |
| 4,208,047 | 6/1980 | Olsen | 272/67 |
| 4,374,588 | 2/1983 | Ruggles | 272/132 |
| 4,611,807 | 9/1986 | Castillo | 272/132 |

*Primary Examiner*—Richard J. Apley
*Assistant Examiner*—Franklin L. Gubernick
*Attorney, Agent, or Firm*—Jennings, Carter, Thompson & Veal

[57] ABSTRACT

A device for toning the biceps, triceps and pectoral muscles utilizes a pair of parallel relatively rotatable disc-like members to maintain the palms of the user in parallel relationship as the arms are rotated about an axis through the disc-like members. The device includes a rotatable handle eccentrically mounted to one of the discs and an adjustable resistance operatively connected to the disc.

10 Claims, 2 Drawing Sheets

FIG. 3
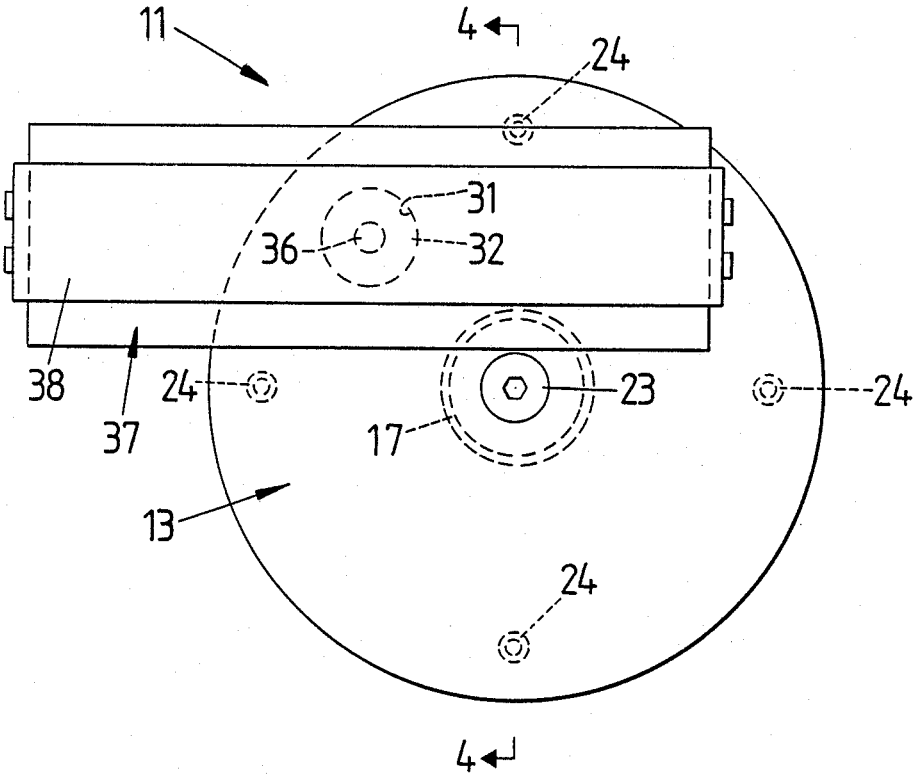
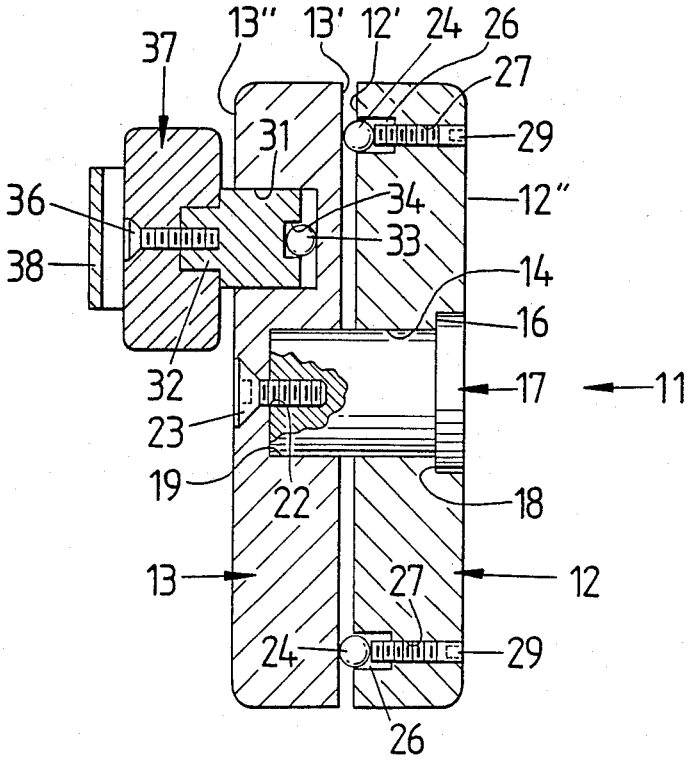
FIG. 4

ARM EXERCISING APPARATUS

FIELD OF THE INVENTION

The present invention relates to exercise apparatus and more particularly to a device which can be used to exercise and tone the triceps, biceps, and pectoral muscles.

BACKGROUND OF THE INVENTION

Numerous exercise devices are known which use rotary manipulation to exercise the muscles of the body. Many such devices are known for specialized use such as U.S. Pat. No. 4,093,210 which is intended to strengthen the muscles of the forearm. Simjian has numerous patents on rotary platforms, i.e. U.S. Pat. No. 3,784,193; No. 4,026,279; No. 4,313,603; and No. 4,390,180. Other exercising devices which use rotary motion include U.S. Pat. No. 4,171,802; No. 4,374,588; No. 4,703,928; and No. 2,777,439; however, none of these devices are seen to cooperate with or exercise the group of muscles in the triceps, biceps, and pectoral region as is required to achieve proper toning.

SUMMARY OF THE INVENTION

It is the object of the present invention to provide optimum toning to the bicep, tricep and pectoral muscles without inducing severe stress or strain on such muscles.

Yet another object of the invention is to provide an arm exerciser which can be used in a limited area such as at a desk.

Still another object of the invention is to provide an arm exerciser which can be used while sitting, standing, or lying down, and which requires no auxiliary equipment.

My apparatus accomplishes each of these objects and may be advantageously used by anyone who has two hands. The concept behind the device is not so much working muscle against muscle as it is working muscles with muscles, thus my invention provides a means for positioning the hands of the user at arms' length so that they may be moved relative to one another to exercise the upper arm. The apparatus further includes means for varying the resistance which the hands must overcome to achieve the desired motion.

BRIEF DESCRIPTION OF THE DRAWINGS

Apparatus embodying features of my invention are depicted in the accompanying drawings which form a portion of this disclosure and wherein:

FIG. 3 is a plan view of the apparatus as seen from the handle side;

FIG. 4 is a sectional view along line 4—4 of FIG. 3.

DESCRIPTION OF A PREFERRED EMBODIMENT

Figure 1:
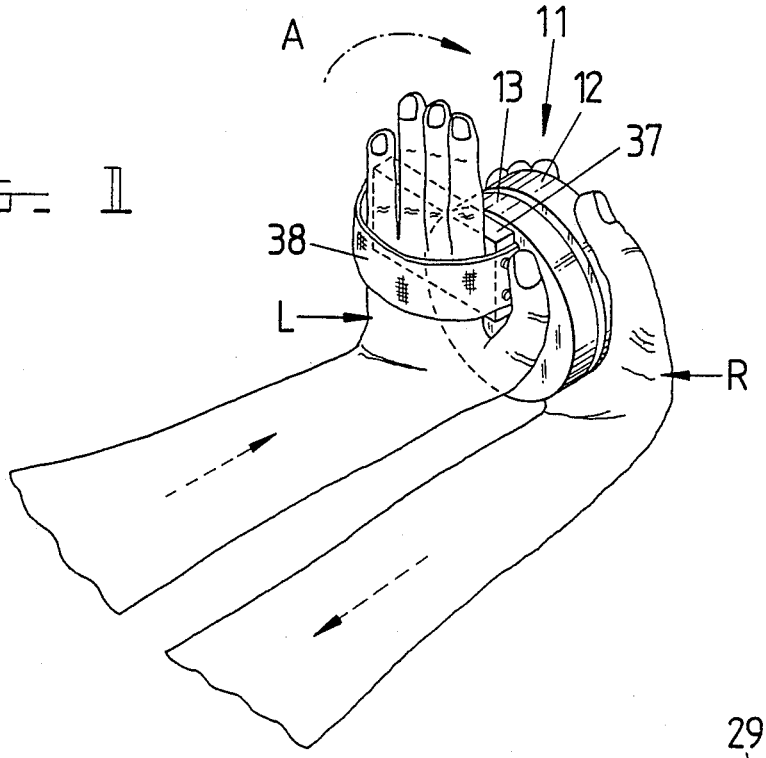
FIG. 1 is a perspective view showing my apparatus in use.

For a clearer understanding of the invention, it is deemed preferable to first consider its utilization, therefore reference is made to FIG. 1 wherein the user's hands, R & L, are shown holding my apparatus 11 in the normal use position. As will be appreciated, the wrists of the user are flexed to maintain the palms of the hands, R & L, in substantially parallel planes. The apparatus 11, held between the hands, R & L, allows relative rotary motion of the hands, R & L, as shown by arrow A, while maintaining the near parallel alignment of the palms. The hands, R & L, may apply varying degrees of pressure to the apparatus 11 in accordance with the comfort of the user. The motion and stresses induced by the use of the apparatus provide beneficial toning of the musculature of the triceps, biceps, and pectorals.

Figure 2:
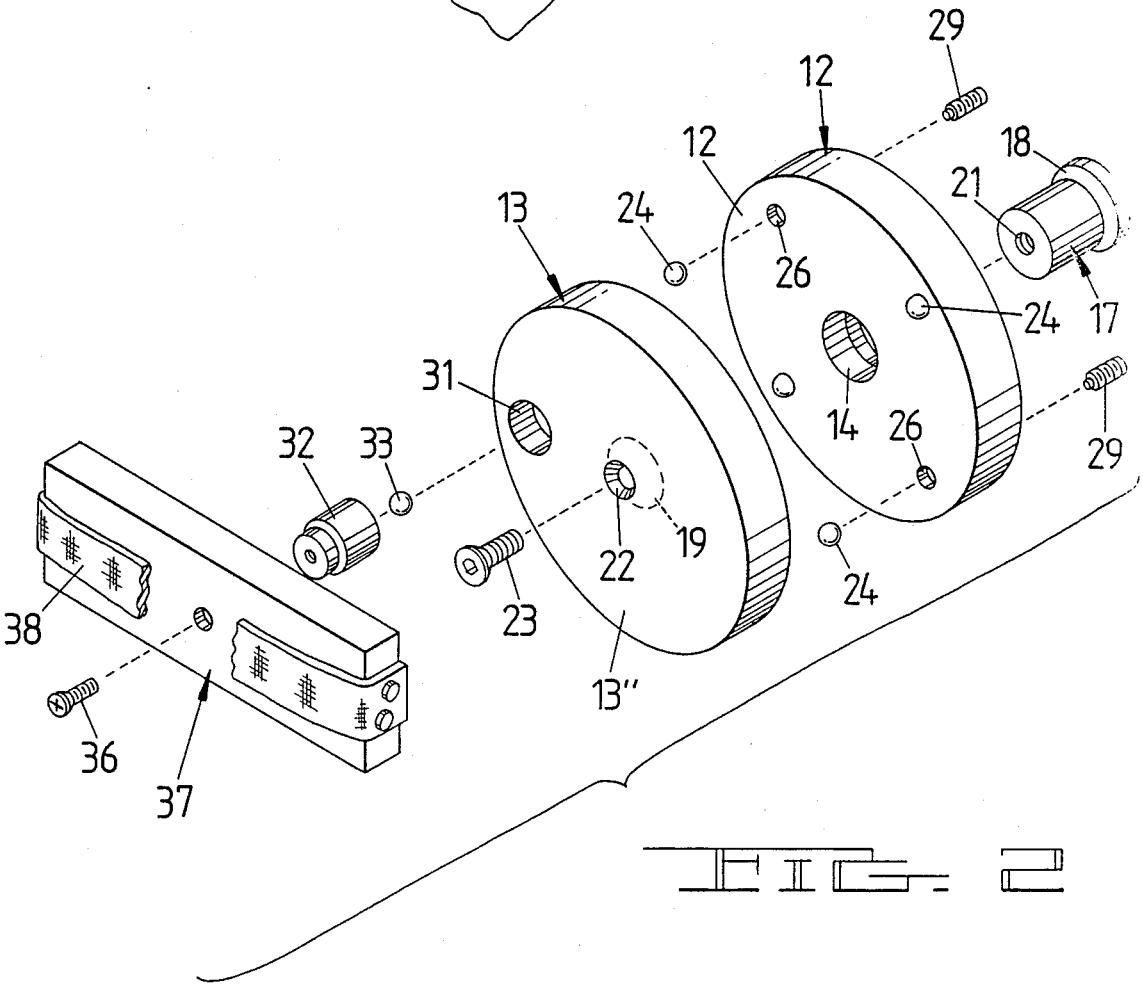
FIG. 2 is an exploded perspective view showing the component parts of the apparatus.

The cooperation of the parts of the apparatus 11 will be discussed with reference to FIGS. 2–4. The apparatus utilizes a pair of equally sized disc-like members 12 and 13 which can be held in the user's hand as shown in FIG. 1. The disc-like members are made of a suitable material, such as nylon, which is durable and readily available. The first disc-like member 12 has a central aperture 14 formed therein with the aperture 14 forming a recessed seat 16 at one side of the disc-like member 12. A pin 17 with a shoulder 18 is insertable into the aperture 14 such that shoulder 18 abuts seat 16 and the disc-like member 12 is rotatable thereon. The pin 17 extends through the first disc-like member 12 and into a central recess 19 in the second disc-like member 13. A threaded central bore 21 is formed in the pin 17 and aligned with an orifice 22 which is concentric with the recess 19 and which receives therein a threaded member 23 for engagement within the threaded bore 21. Thus pin 17 and threaded member 23 serve to hold the disc-like members 12 and 13 together with the disc-like member being rotatable relative to each other about the axis of pin 17.

A plurality of steel balls 24 are captured in receptacle 26 formed in the inner surface 12′ of disc-like member 12. A threaded passageway 27 extends through the disc-like member 12 from each receptacle to the outer surface 12″ of disc-like member 12. The steel balls 24, when captured in the receptacle 26, bear against the inner surface 13′ of disc-like member 13. A set screw 29 threadedly engages each passageway 27 and is adjustable to urge each ball 24 against surface 13′ with a desired force thereby providing a desired resistance to relative rotation of the disc-like members 12 and 13.

The outer surface 13″ of disc-like member 13 is provided with a recess 31, located eccentrically relative to the orifice 22. A pin 32 fits within the recess 31 and carries a ball bearing 33 in a depression 34 in one end thereof such that the pin 32 is freely rotatable in the recess 31. Affixed to the pin 32 as with a screw 36 is a rectangular handle 37. An elastic strap 38 is fastened to the handle 37 at the ends thereof, such that a hand, R or L, may be inserted between the handle 37 and the strap 38 as shown in FIG. 1.

From the foregoing, it should be clear that the set screw 29 and threaded member 23 are recessed below the surfaces 12″ and 13″ and can be adjusted with allen wrenches to provide the desired resistance to rotation of the disc-like members.

While I have shown my invention in one form, it will be obvious to those skilled in the art that it is not so limited but is susceptible of various changes and modifications without departing from the spirit thereof.

What I claim is:

1. Muscle toning apparatus for the arms, comprising:

(a) a pair of hand-held disc-like members coaxially mounted for relative rotation in parallel planes;

(b) means operatively connected to said discs for varying the resistance of said disc-like members to relative rotation; and (c) handle means mounted eccentrically to one of said disc-like members such that the palms of the user's hands are constrained to remain parallel during relative rotation of said disc-like members said handle means being rotatable about its axis and independent from said resistance means.

2. Apparatus as defined in claim 1 wherein said handle means comprises a planar elongated member rotatably mounted at the longitudinal center thereof to one of said disc-like members; and a strap affixed to and extendng the length of said elongated member such that the user's hand may be inserted between said elongated member and said strap.

3. Apparatus as defined in claim 1 wherein said means for varying the rotational force comprises a plurality of recesses formed in the surface of one of said disc-like members adjacent the other disc-like member, a ball bearing captured within each recess; and a set screw associated with each recess for urging said ball bearing against the adjacent surface of the other disc-like member.

4. Apparatus for conditioning and toning the biceps, triceps and pectoral muscles comprising:

(a) a first disc-like member sized to fit within a user's hand;

(b) a second disc-like member of the same size as said first disc;

(c) means for joining said disc-like members along a common central axis for relative rotation about said central axis with said disc-like members remaining parallel and proximal one another;

(d) means operatively connected to said discs for varying the rotational force required for rotating said first and second disc-like members relative to each other; and (e) handle means engagable by a user's other hand eccentrically mounted to said second disc-like member and rotatable relative thereto for rotating said second disc-like member relative to said first disc-like member such that the palms of the user's hands remain substantially parallel during relative rotation of said disc-like members said handle means being rotatable about its axis and independent from said resistance means.

5. Apparatus as defined in claim 4 wherein said handle means comprises a planar elongated member rotatably mounted at the longitudinal center thereof to said second disc-like member; and a strap affixed to and extending the length of said elongated member such that the user's hand may be inserted between said elongated member and said strap.

6. Apparatus as defined in claim 5 wherein said means for varying the rotational force comprises a plurality of recesses formed in the surface of one of said disc-like members adjacent the other disc-like member, a ball bearing captured within each recess; and a set screw associated with each recess for urging said ball bearing against the adjacent surface of the other disc-like member.

7. Apparatus as defined in claim 4 wherein said means for varying the rotational force comprises a plurality of recesses formed in the surface of one of said disc-like members adjacent the other disc-like member, a ball bearing captured within each recess; and a set screw associated with each recess for urging said ball bearing against the adjacent surface of the other disc-like member.

8. Apparatus as defined in claim 4 wherein said means for joining said disc-like members comprises:

(a) a connecting pin insertable into a central aperture in said first disc-like member, said aperture and said pin having cooperatively formed shoulders for seating said pin in said disc-like members, and into a central recess in said second disc-like member, with said pin having a threaded bore formed axially therein at one end; and (b) a threaded member insertable coaxially into threaded engagement with said threaded bore through an aperture in said second disc coaxially aligned with said central recess, said threaded member securing said pin to said second disc-like member.

9. Apparatus as defined in claim 8 wherein said handle means comprises a planar elongated member rotatably mounted at the longitudinal center thereof to said second disc-like member; and a strap affixed to and extending the length of said elongated member such that the user's hand may be inserted between said elongated member and said strap.

10. Apparatus as defined in claim 8 wherein said means for varying the rotational force comprises a plurality of recesses formed in the surface of one of said disc-like members adjacent the other disc-like member, a ball bearing captured within each recess; and a set screw associated with each recess for urging said ball bearing against the adjacent surface of the other disc-like member.

* * * * *